US009259952B2

(12) United States Patent
Yamada et al.

(10) Patent No.: US 9,259,952 B2
(45) Date of Patent: Feb. 16, 2016

(54) INK-JET PRINTING APPARATUS AND METHOD OF PRINTING SEAMLESS CANS BY USING THE SAME PRINTING APPARATUS

(75) Inventors: Koji Yamada, Yokohama (JP); Kenji Hayashi, Shinagawa-ku (JP)

(73) Assignee: TOYO SEIKAN GROUP HOLDINGS, LTD., Tokyo (JP)

( * ) Notice: Subject to any disclaimer, the term of this patent is extended or adjusted under 35 U.S.C. 154(b) by 0 days.

(21) Appl. No.: 14/110,597

(22) PCT Filed: Apr. 23, 2012

(86) PCT No.: PCT/JP2012/060870

§ 371 (c)(1), (2), (4) Date: Oct. 8, 2013

(87) PCT Pub. No.: WO2012/147695

PCT Pub. Date: Nov. 1, 2012

(65) Prior Publication Data

US 2014/0028771 A1 Jan. 30, 2014

(30) Foreign Application Priority Data

Apr. 28, 2011 (JP) ..... 2011-101936

(51) Int. Cl.
*B41J 2/01* (2006.01)
*B41M 1/40* (2006.01)
(Continued)

(52) U.S. Cl.
CPC ..... *B41M 1/40* (2013.01); *B41J 2/0057* (2013.01); *B41J 3/4073* (2013.01); *B41M 5/0088* (2013.01); *B41J 2/16508* (2013.01);
(Continued)

(58) Field of Classification Search
CPC ..... B41J 2/01; B41J 3/42; B41J 3/44; B41M 1/04; B41M 1/06; B41M 1/18; B41M 1/40; B41M 5/0088; B41M 7/02
USPC ..... 347/20, 101, 104; 101/38.1, 486
See application file for complete search history.

(56) References Cited

U.S. PATENT DOCUMENTS 6,254,218 B1 * 7/2001 Suzuki et al. ..... 347/43
6,769,357 B1 * 8/2004 Finan ..... 101/38.1
(Continued)

FOREIGN PATENT DOCUMENTS

CA 1277176 C 12/1990
EP 0209896 A2 1/1987
(Continued)

OTHER PUBLICATIONS

Communication dated Sep. 12, 2014, issued by the European Patent Office in counterpart Application No. 12777811.6.
(Continued)

*Primary Examiner* — Henok Legesse
(74) *Attorney, Agent, or Firm* — Sughrue Mion, PLLC

(57) ABSTRACT

An ink-jet printing apparatus for printing seamless cans comprising a mandrel wheel, a plurality of mandrels that can rotate and are provided on the mandrel wheel, and ink-jet printing stations for ink-jet printing images on at least the can walls on the outer surfaces of seamless cans fitted onto the mandrels, and a method of printing seamless cans by using the same apparatus. A plurality of ink-jet heads are arranged in each of the ink-jet printing stations to improve reproduceability of printing and productivity.

10 Claims, 13 Drawing Sheets

(51) Int. Cl.

| | |
|---|---|
| ***B41J 2/005*** | (2006.01) |
| ***B41M 5/00*** | (2006.01) |
| ***B41J 3/407*** | (2006.01) |
| *B41J 3/54* | (2006.01) |
| *B41J 11/00* | (2006.01) |
| *B41J 2/165* | (2006.01) |

(52) U.S. Cl.

CPC ..... *B41J2/16526* (2013.01); *B41J 2/16538* (2013.01); *B41J 2/16552* (2013.01); *B41J 3/546* (2013.01); *B41J 11/002* (2013.01); *B41J 11/0015* (2013.01)

(56) References Cited

U.S. PATENT DOCUMENTS

| | | | | |
|---|---|---|---|---|
| 7,905,174 | B2 | 3/2011 | Vetter | |
| 2004/0252174 | A1 | 12/2004 | Baxter et al. | |
| 2006/0018698 | A1* | 1/2006 | Vogt | 400/149 |
| 2006/0137548 | A1* | 6/2006 | Vetter | 101/38.1 |
| 2007/0157559 | A1 | 7/2007 | Till | |
| 2010/0192517 | A1* | 8/2010 | Schach | 53/411 |
| 2011/0018931 | A1* | 1/2011 | Ikeda | 347/29 |
| 2011/0074870 | A1 | 3/2011 | Maida | |

FOREIGN PATENT DOCUMENTS

| | | | | | |
|---|---|---|---|---|---|
| JP | 62-027170 | A | | 2/1987 | |
| JP | 08-207265 | | * | 8/1996 | B41J 2/01 |
| JP | 08-207265 | A | | 8/1996 | |
| JP | 2004-042464 | A | | 2/2004 | |
| JP | 2005-531428 | A | | 10/2005 | |
| JP | 2008-062455 | A | | 3/2008 | |
| JP | 2010-143200 | A | | 7/2010 | |
| JP | 2010-535112 | A | | 11/2010 | |
| JP | 4615999 | B2 | | 1/2011 | |
| JP | 2011-073339 | A | | 4/2011 | |
| WO | 2011/032939 | A1 | | 3/2011 | |

OTHER PUBLICATIONS

Communication (Third Party Observation) dated Jul. 1, 2015, issued by the European Patent Office in corresponding European patent application No. 12777811.6.

* cited by examiner

| | Arrangements of stations and heads |
|---|---|
| Ex. 1 |  |
| Ex. 2 |  |
| Ex. 3 |  |
| Ex. 4 |  |
| Comp. Ex. 1 |  |
| Comp. Ex. 2 |  |

INK-JET PRINTING APPARATUS AND METHOD OF PRINTING SEAMLESS CANS BY USING THE SAME PRINTING APPARATUS

CROSS REFERENCE TO RELATED APPLICATIONS

This application is a National Stage of International Application No. PCT/JP2012/060870 filed Apr. 23, 2012, claiming priority based on Japanese Patent Application No. 2011-101936 filed Apr. 28, 2011, the contents of all which are incorporated herein by reference in their entirety.

TECHNICAL FIELD

This invention relates to an ink-jet printing apparatus and to a method of printing seamless cans by using the same printing apparatus. More specifically, the invention relates to an ink-jet printing apparatus for printing seamless cans featuring excellent reproduceability of printing, high printing speed and excellent productivity, and to a printing method by using the same printing apparatus.

BACKGROUND ART

Seamless cans made from a metal such as aluminum or steel have large shock resistance and do not permit gases such as oxygen to pass through, offer such advantages as far superior preservability of the contents to the plastic containers as well as small weight as compared to glass bottles, and have been widely used as containers for containing carbonated beverages, alcohol beverages and many other beverages and foods.

Trade names and a variety of designs have been printed on the outer surfaces of the cans by the plate-type printing using a printing plate, such as offset printing (patent document 1), by the ink-jet printing without using the printing plate, or by the printing systems based on a combination thereof (patent documents 2 to 4).

The plate-type printing executes a multi-color printing by preparing plates for each of the ink colors, and is efficient when the seamless cans having the same image are to be mass-produced. When the design being printed is to be changed, however, the plates must be newly prepared. Namely, the plate-type printing requires an extended period of time for changing the design, has no freedom for changing the design that is to be printed specifically in the production within short due terms or in the production of small lots, and can print only limited kinds of designs.

The ink-jet printing, on the other hand, requires no plate offering such advantages that the design to be printed can be freely changed in short periods of time (variability), that the ink can be thickly printed enabling images with deepness to be formed and that highly fine images such as photographs can be excellently reproduced.

PRIOR ART DOCUMENTS

Patent Documents:

Patent document 1: JP-A-2008-62455
Patent document 2: JP-A-2004-42464
Patent document 3: Japanese Patent No. 4615999
Patent document 4: JP-A-2010-143200

OUTLINE OF THE INVENTION

Problems that the Invention is to Solve

However, the ink-jet printing, usually, needs a plurality of ink-jet heads that correspond to four process colors of cyan, magenta, yellow and black and, therefore, requires an increased number of printing stations as in the apparatus described in the above patent document 3 causing the printing apparatus to become bulky. Besides, in the case of printing fine images, a difficulty is involved in positioning the printing stations, and the image often deviates.

Further, the printing system is based on a principle of impinging ink droplets from ink heads and imposes limitation on the area of printing or on the speed of printing due to the limitation on the width of the heads and on the frequency of ejecting liquid droplets. Further, to increase the density of dots, the cans had to be rotated at a low speed or the cans had to be rotated a few turns leaving a problem from the standpoint of productivity. Further, some seamless cans are tall (high) and others are short though they may have the same can body diameter. Therefore, when the cans of different kinds are to be printed, the head positions must be adjusted and, besides, the heads must be regularly cleaned hindering the productivity even from the standpoint of these points.

The above patent document 4 describes a printing apparatus for ink-jet printing cylindrical bodies such as tubes by using a plurality of ink-jet heads. With this ink-jet printing apparatus, however, it is difficult to efficiently produce the printed seamless cans.

It is, therefore, an object of the present invention to provide an ink-jet printing apparatus featuring excellent reproduceability of printing, high printing speed and excellent productivity, and a method of printing the seamless cans by using the same printing apparatus.

Another object of the present invention is to provide an ink-jet printing apparatus capable of constituting a variety of systems for printing the seamless cans at a plurality of positions and for easily printing the seamless cans of dissimilar heights, and to provide a method of printing the seamless cans by using the same printing apparatus.

Means for Solving the Problems

According to the present invention, there is provided a printing apparatus for printing seamless cans comprising a mandrel wheel, a plurality of mandrels that can rotate and are provided on the mandrel wheel, and ink-jet printing stations for ink-jet printing images on at least the can walls on the outer surfaces of seamless cans fitted onto the mandrels, wherein the ink-jet printing is executed in at least one ink-jet printing station, and a plurality of ink-jet heads are arranged in the ink-jet printing station.

In the printing apparatus for printing seamless cans of the invention, it is desired that:

1. The plurality of ink-jet heads arranged in the ink-jet printing station can be moved in the direction of height of the seamless cans fitted onto the mandrels;
2. The plurality of ink-jet heads arranged in the ink-jet printing station are provided at positions facing each other with the seamless can fitted onto the mandrel therebetween;
3. A false-curing station and a finishing varnish application station are successively provided at positions on the downstream of the ink-jet printing station;
4. A plate-type printing station is provided at a position either upstream or downstream of the ink-jet printing station to print images on at least the can walls on the outer surfaces of the seamless cans by plate-type printing;

5. A head-cleaning device coupled to the ink-jet heads is arranged in the ink-jet printing station; and
6. The head-cleaning device is shared by at least two ink-jet heads.

According to the present invention, there is provided a method of printing images by ink-jet printing on at least the can walls on the outer surfaces of seamless cans, wherein the ink-jet printing is executed by using a plurality of ink-jet heads in at least one time of printing step.

In the method of printing seamless cans of the present invention, it is desired that:

1. The images are formed on at least the can walls on the outer surfaces of the seamless cans by moving the ink-jet heads in the direction of height; and
2. The seamless cans on which the ink-jet printing is to be executed are the seamless cans on which the images have been printed by the plate-type printing.

Effects of the Invention

In the ink-jet printing apparatus of the present invention, an important feature resides in that a plurality of ink-jet heads are arranged in at least one printing station making it possible to increase the rotating speed of the cans despite the printing stations are used in the same number as that of the prior art and, therefore, to increase the printing speed (difference between Examples 1-4 and Comparative Example 1 in Table 1).

Upon arranging a plurality of ink-jet heads in each ink-jet printing station, it is allowed to decrease the number of the printing stations when the heads are used in the same number as that of the prior art. This makes it possible to decrease the deviation of the image that stems from the fact that it is difficult to attain fine positioning among the printing stations due to error in the mechanical precision and due to error in the size of the mandrels. Accordingly, it is allowed to finely reproduce the printed images (difference between Examples 1-3 and Comparative Example 2 in Table 1).

Further, upon arranging a plurality of ink-jet heads in each ink-jet printing station, the dots can be precisely impinged among the dots impinged earlier by slightly deviating the neighboring ink-jet heads; i.e., the dot density can be increased and the resolution can be improved (difference between Examples 1-4 and Comparative Examples 1-2 in Table 1).

Upon using a plurality of ink-jet heads, further, the dots can be applied in an overlapped manner maintaining precision, increasing the thickness of the ink so that the image can be printed offering increased appeal of density (difference between Examples 1-4 and Comparative Examples 1-2 in Table 1).

Further, by arranging a plurality of ink-jet heads, it is made possible to decrease the number of the printing stations and, therefore, to decrease the size of the printing apparatus (difference between the Examples 1-4 and Comparative Example 2 in Table 1).

In the printing apparatus of the present invention, further, the ink-jet heads are allowed to move in the direction of height of the seamless cans fitted onto the mandrels making it possible to easily execute the printing onto a plurality of positions of the seamless cans in the direction of height and onto the seamless cans of different heights. By arranging the ink-jet heads in an overlapped manner but being slightly deviated in the direction of height of the can, further, it is allowed to print an image close to a straight line, to vividly express the contour of the image, and to form straight lines like those of bar codes.

Further, with the head-cleaning device being coupled to a plurality of ink-jet heads in an ink-jet printing station, the printing can be executed by one ink-jet head while the other ink-jet head is being cleaned; i.e., the printing can be continued while conducting the cleaning at the same time (difference between Examples 1-4 and Comparative Example 1 in Table 1). Besides, since the head-cleaning device is shared by a plurality of ink-jet heads, the size of the printing apparatus can be further decreased in addition to decreasing the number of the printing stations.

By combining the ink-jet printing apparatus of the invention with the plate-type printing apparatus, further, the image which can be varied by the ink-jet printing can be combined with the image that is solidly printed by the plate-type printing and that features excellent reproduceability of density. It is, therefore, made possible to deal with a variety of designs in small lots that could not be dealt with by the plate-type printing alone and to excellently reproduce image density that could not be attained by the ink-jet printing alone. Moreover, it is made possible to provide printed seamless cans having vividly printed images wherein the images by the ink-jet printing are formed on the images by the plate-type printing.

Moreover, the ink-jet printing apparatus of the present invention can be realized in a small size as described above and is suited for suppressing the size in realizing a hybrid printing apparatus which tends to become bulky upon being combined with the plate-type printing apparatus.

MODES FOR CARRYING OUT THE INVENTION (Ink-jet printing apparatus)

When the seamless cans are to be printed on at least the outer surfaces of their can walls, there is used a printing apparatus in which the seamless cans are rotatably fixed onto the mandrels formed on the mandrel wheel, and the ink-jet printing is executed by the printing stations installed along the mandrel wheel featuring excellent productivity. Therefore, the ink-jet printing apparatus of the present invention, too, employs a conveyer mechanism. In this apparatus, the seamless cans are introduced, printed and discharged continuously.

Figure 1:
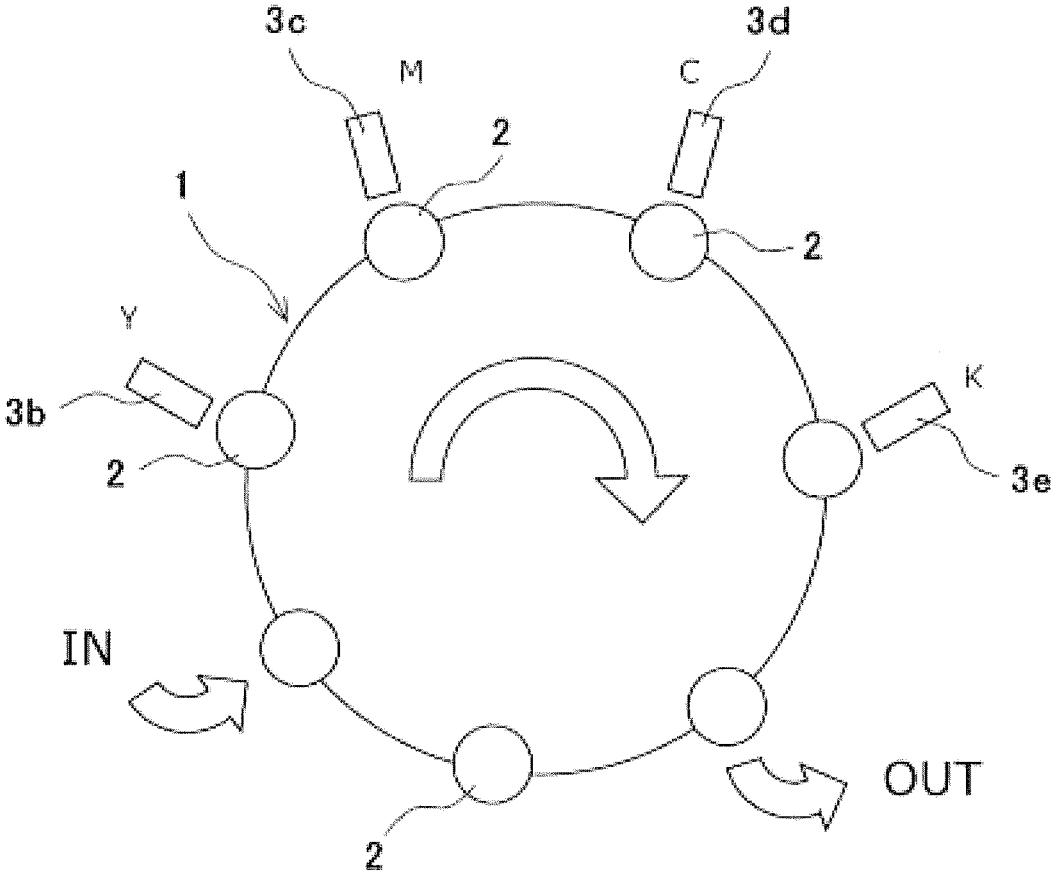
[FIG. 1] is a view schematically illustrating a conventional ink-jet printing apparatus.

In a conventional ink-jet printing apparatus schematically shown in FIG. 1, a plurality of mandrels 2 are disposed on a mandrel wheel 1 maintaining an equal distance, the mandrel wheel 1 intermittently revolving clockwise and the mandrels 2 rotating clockwise on their axes in each station. Along the mandrel wheel 1 on the outer side of the circumference thereof, there are arranged the printing stations having, respectively, one of the ink-jet heads 3*b* to 3*e* corresponding the inks of yellow (Y), magenta (M), cyan (C) and black (K).

The seamless cans introduced and fitted onto the mandrels are subjected to the spray of ink droplets from the printing stations of each of the colors successively, and images are printed on the seamless cans fitted onto the mandrels 2. The seamless cans on which the images are printed are taken out from the mandrels; i.e., the printed seamless cans are completed.

Figure 2:
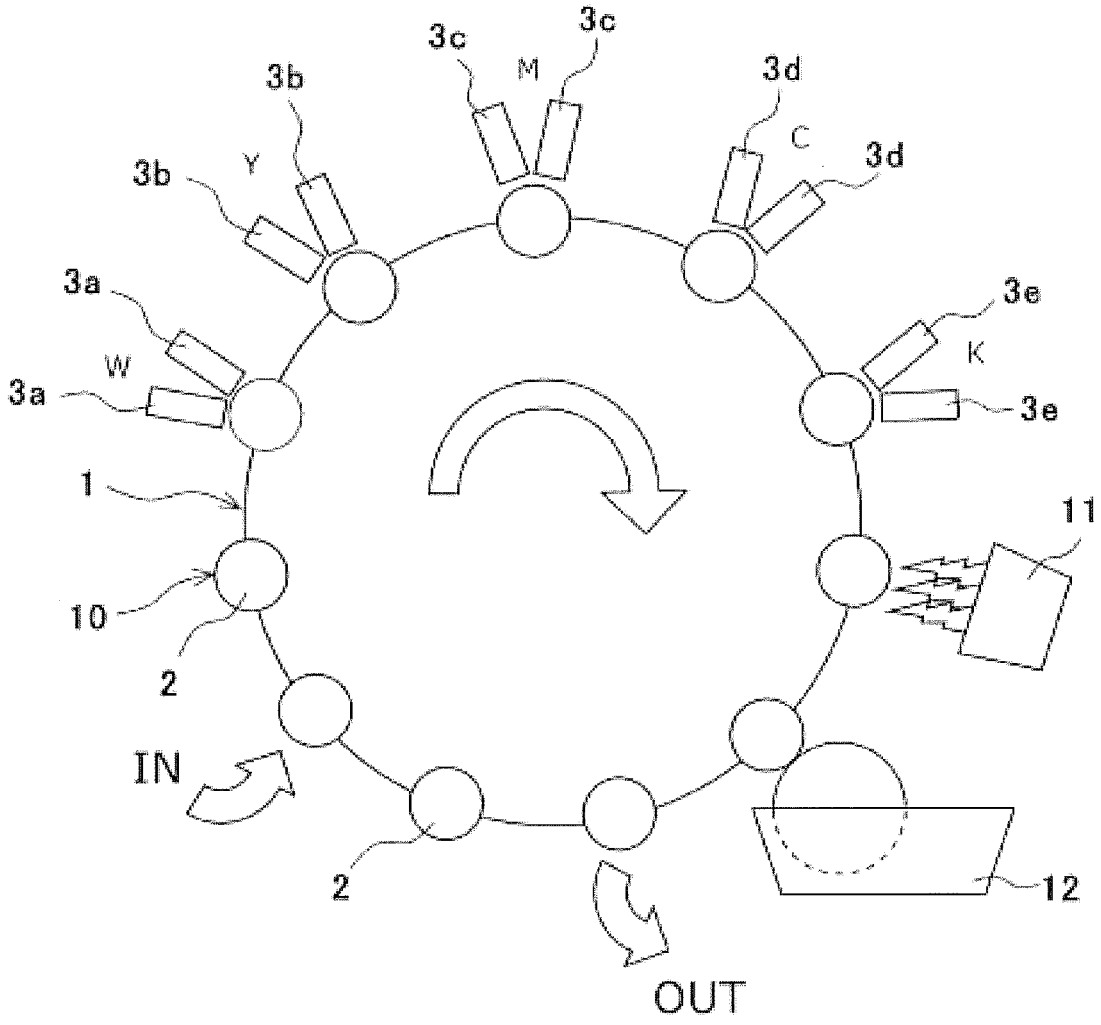
[FIG. 2] is a view schematically illustrating an ink-jet printing apparatus of the present invention.

The ink-jet printing apparatus of the present invention schematically shown in FIG. 2 has the structure which is basically the same as that of the conventional ink-jet printing apparatus, but has an important feature in that a plurality of ink-jet heads are provided in each of the printing stations. This provides superior actions and effects to those of the conventional ink-jet printing apparatus as described above.

That is, in the ink-jet printing apparatus of the present invention, the ink-jet heads 3*a* to 3*e* are provided each in a number of two in the respective printing stations corresponding to the inks of white (W), yellow (Y), magenta (M), cyan (C) and black (K), featuring faster printing speed than the printing stations each having one ink-jet head, higher dot density and improved resolution, increased thickness of ink due to overlapped application of ink maintaining precise dots, and offering printed images of high density appeal. As described above, each station has a plurality of ink-jet heads containing the ink of the same color to produce large effect. However, it is also allowable to provide the plurality of ink-jet heads containing the inks of different colors. In this case, the printing can be executed with a decreased number of the stations offering advantage from the standpoint of maintenance of the injection heads.

In the ink-jet printing apparatus of the invention, further, a printing station of white (W) ink-jet is provided preceding each of the printing stations of yellow (Y), magenta (M), cyan (C) and black (K) so that the printing can be executed in white when necessary. Before conveyed to the printing stations, further, the step of positioning for printing is provided as required (designated by reference numeral 10 in FIG. 2). As required, further, the seamless cans on which the images are printed are false-cured (false-baked) (designated by reference numeral 11 in FIG. 2), coated with the finishing varnish (designated by reference numeral 12 in FIG. 2), removed from the mandrels, and are subjected to the step of main baking to obtain the printed seamless cans in a complete form. Arrangement of the printing stations of the above colors on the mandrel wheel is not limited to the diagramed example only but maybe of any order. In the diagramed concrete example, further, the step of positioning is provided preceding the ink-jet printing. The step of positioning, however, may be omitted depending on the printed images.

Figure 3:
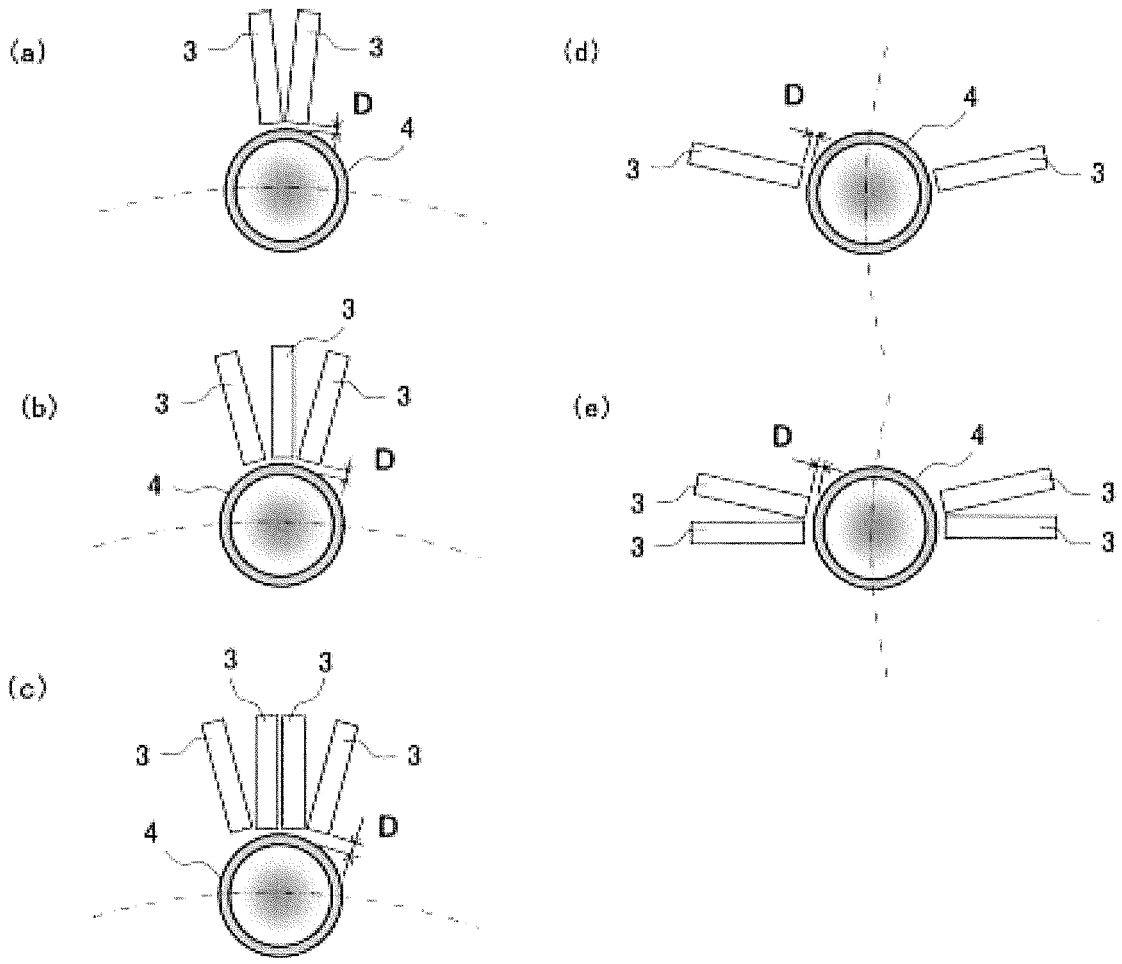
[FIG. 3] is a view illustrating the arrangement of ink-jet heads in the ink-jet printing apparatus of the present invention.

The ink-jet printing apparatus of the present invention may assume various embodiments without limitation so far as a plurality of ink-jet heads are arranged in each printing station. FIG. 3 shows examples of arrangement of the ink-jet heads relative to the mandrel.

FIGS. 3(*a*) to (*c*) show examples in which two, three and four ink-jet heads 3 are arranged on the outer side of the circumference of the mandrel wheel (in the drawings, dotted lines represent the track thereof), while FIGS. 3(*d*) and (*e*) show examples in which one or two ink-jet heads are arranged on the outer side and on the inner side of the mandrel wheel with the seamless can 4 fitted on the mandrel 2 interposed therebetween.

In FIGS. 3(*a*) to (*c*), the ejection ports of the ink-jet heads are formed being directed downward (inclusive of downward being tilted), which is particularly desirable from the standpoint of printing precision. Further, in cleaning the heads as will be described later, the one cleaning device can be shared.

Referring to FIGS. 3(*d*) and (*e*), the ejection ports of the ink-jet heads must be directed downward and tilted for executing the printing and cleaning. In this case, however, the ink scratched off at the time of cleaning, the cleaning liquid and blank-shot ink may drip down. Therefore, a liquid drip-preventing mechanism or a liquid receiver is necessary for the cleaning device. On the other hand, there is such an advantage that a plurality of ink-jet heads can be brought close to the surface of the can.

Though FIG. 3 does not clearly show the positional relationship of the ink-jet heads in the direction of height of the seamless can, the ink-jet heads can be moved in the direction of height of the seamless can. Namely, the positions of the plurality of ink-jet heads can be varied depending on the images to be printed, such as being varied in the direction of height of the seamless can in addition to being arranged at the same position in the circumferential direction of the can.

In the ink-jet printing as described above, further, the ink droplets are injected so as to impinge on the surface of the seamless can. From the standpoint of preventing the generation of ink mist, therefore, it is desired that the distance is small over which the ink flies through the space from the ejection portions at the end of the ink-jet heads to the can on where they adhere. Preferably, the distance D is in a range of 0.5 to 4.0 mm from the ejection portions at the end of the ink-jet heads to the surface of the seamless can. If the distance is smaller than 0.5 mm, then the ink-jet heads may often come in contact with the surface of the seamless can.

In the concrete example shown in FIG. 2, further, the ink-jet printed images are false-cured (false-baked) after the final black color-printing station. However, the timing of the false-curing (false-baking) may vary depending on the predetermined image or the kind of the ink used for the ink-jet printing, and may be (i) after the inks of all colors have been fed, (ii) right after each ink is fed, (iii) after an ink is fed but before the next ink is fed, or (iv) twice right after the white ink is fed and after all colors have been fed.

(Head-cleaning device)

In the ink-jet printing apparatus of the present invention, it is desired that a head-cleaning device coupled to the ink-jet heads is arranged in each printing station. Namely, one cleaning device can deal with the plurality of ink-jet heads, i.e., can efficiently clean the ink-jet heads contributing to improving the production efficiency.

Figure 4:
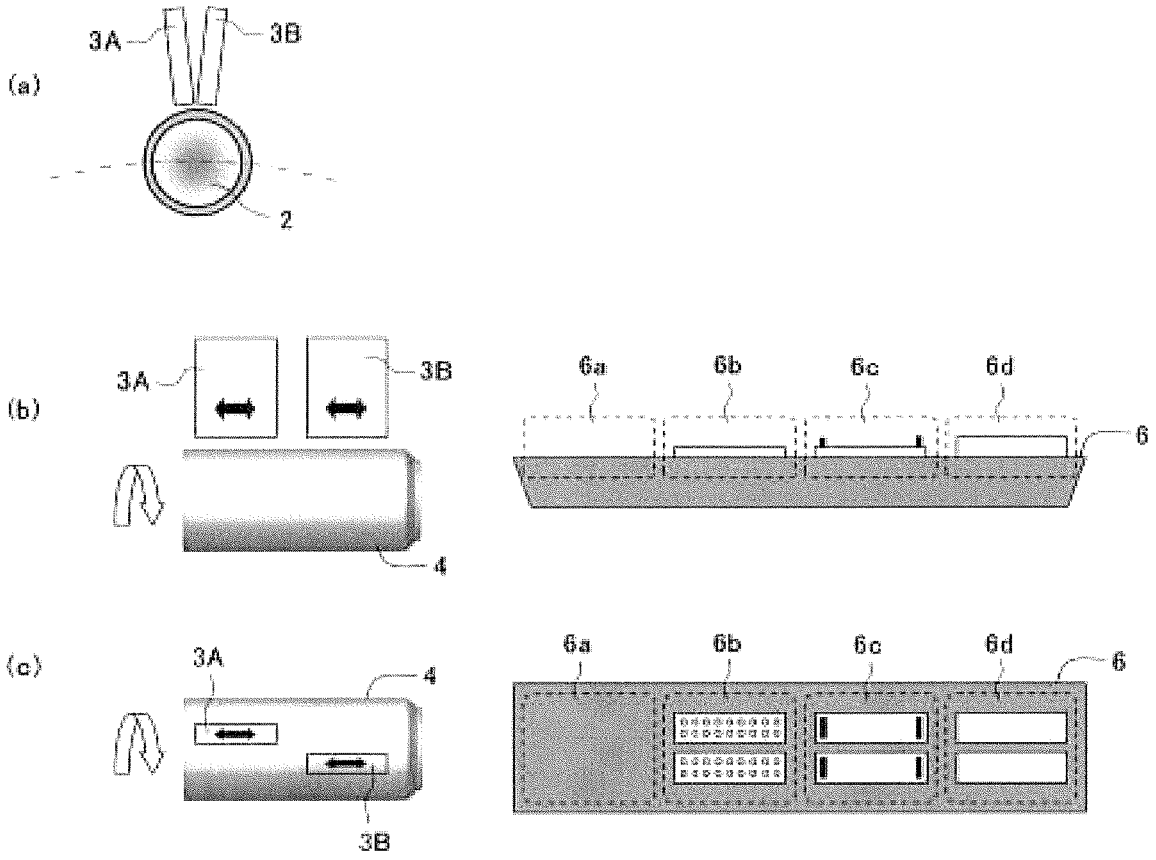
[FIG. 4] is a view illustrating a cleaning structure in the ink-jet printing apparatus of the present invention.

FIG. 4 is a view illustrating a cleaning structure in the ink-jet printing apparatus of the present invention, wherein FIG. 4(*a*) is a view of the ink-jet heads as viewed in a direction in which they move, (*b*) is a view of when the ink-jet heads are viewed from the side, and (*c*) is a view of when the ink-jet heads are viewed from the upper side.

As shown in FIGS. 4(*a*) to (*c*), in the printing station having two ink-jet heads 3A and 3B that can move in the direction of height of the seamless can 4 and arranged on the outer side of the circumference of the mandrel wheel (its track is represented by a dotted line) of the printing apparatus, there is disposed a cleaning device 6 coupled to the ink-jet heads 3A and 3B at a position in the direction of height of the seamless can.

In the cleaning device 6 that is shown, there are arranged a blank-shot area 6*a,* a washing area 6*b,* a wiping area 6*c* and a capping area 6*d* in series in the direction in which the ink-jet heads move from the side of the mandrel for the two ink-jet heads 3A and 3B. The ink-jet heads are cleaned in a manner as described below.

Namely, the ink-jet heads move onto the cleaning device where the ink adhered onto the ink-jet heads is washed away with a cleaning liquid from the lower side in the washing area 6*b.* Next, the ink-jet heads move onto the wiping area 6*c* where the cleaning liquid adhered to the ends of the ink-jet heads is scratched off with a wiper. Next, the ink-jet heads move onto the capping area 6*d,* and are fitted with a cap and stand by.

Next, the ink-jet heads move onto the wiping area where the ink adhered to the ends of the ink-jet heads is scratched off with the wiper. The ink-jet heads, next, move toward the mandrel. In the blank-shot area 6*a,* the ink is blank-shot a few times, and the ink-jet heads move onto the image printed on the seamless can 4 fixed onto the mandrel 2 to resume the printing. When the printing is to be continued, the step of capping and standby may be omitted. When not used for extended periods of time, it is desired that the ink-jet heads are capped.

The cleaning device used in the ink-jet printing apparatus of the present invention may employ the constitution that has heretofore been used for cleaning the ink-jet heads. In the invention, however, each printing station has been provided with a plurality of ink-jet heads. It is, therefore, desired that the cleaning device is coupled to the plurality of ink-jet heads and is shared by the plurality of ink-jet heads to simplify the constitution of the apparatus and to realize the apparatus in a compact size.

(Printing inks)

As the printing inks used for the ink-jet printing of the invention, there can be used heat-drying inks, heat-curing inks, ultraviolet ray-curing inks or electron ray-curing inks that have heretofore been used for ink-jet-printing the seamless cans. Among them, however, the heat-drying inks or the heat-curing inks are preferred from such a standpoint that the facility for baking is inexpensive though it may become necessary to employ curing means or to execute false-baking depending on the inks that are used.

The heat-drying inks include those of the aqueous type, oil type and solvent type. Among them, the solvent types are preferred since the time needed for the curing is short.

As the system of the ink-jet heads used for the ink-jet printing, further, there have been known electrostatic system, piezo system, bubble-jet system and the like system which can be used in the present invention without limitation.

(Applying the finishing varnish)

In the ink-jet printing apparatus of the present invention as described above, the ink-jet printing is executed, the images formed by the ink-jet printing are false-cured (false-baked) and, thereafter, the finishing varnish is applied thereon. This assures excellent adhesion of the printed images as well as scratch resistance of the printed seamless cans when the printed seamless cans are subjected to such workings as retort-sterilization and double-seaming or when they are rubbed by each other during the transit.

As the finishing varnish used for producing the printed seamless cans of the invention, there can be used a transparent coating material that has heretofore been used as a top coating of the printed seamless cans and, particularly preferably, coating material of the heat-curing type.

After the finishing varnish has been applied, when the heat-curing ink is used for the ink-jet printing simultaneously with the baking of the finishing varnish, the image formed by the ink-jet printing is baked to thereby produce the printed seamless cans of the present invention.

(Hybrid printing apparatus)

The ink-jet printing apparatus of the present invention can be used alone for printing the seamless cans. By using the plate-type printing in combination, however, it becomes possible to combine variable images by the ink-jet printing and solidly printed images by the plate-type printing having excellent reproducibility of density. This makes it possible to deal with a variety of designs in small lots that could not be handled by the plate-type printing alone and excellently reproduces image densities that could not be done by the ink-jet printing alone.

Figure 5:
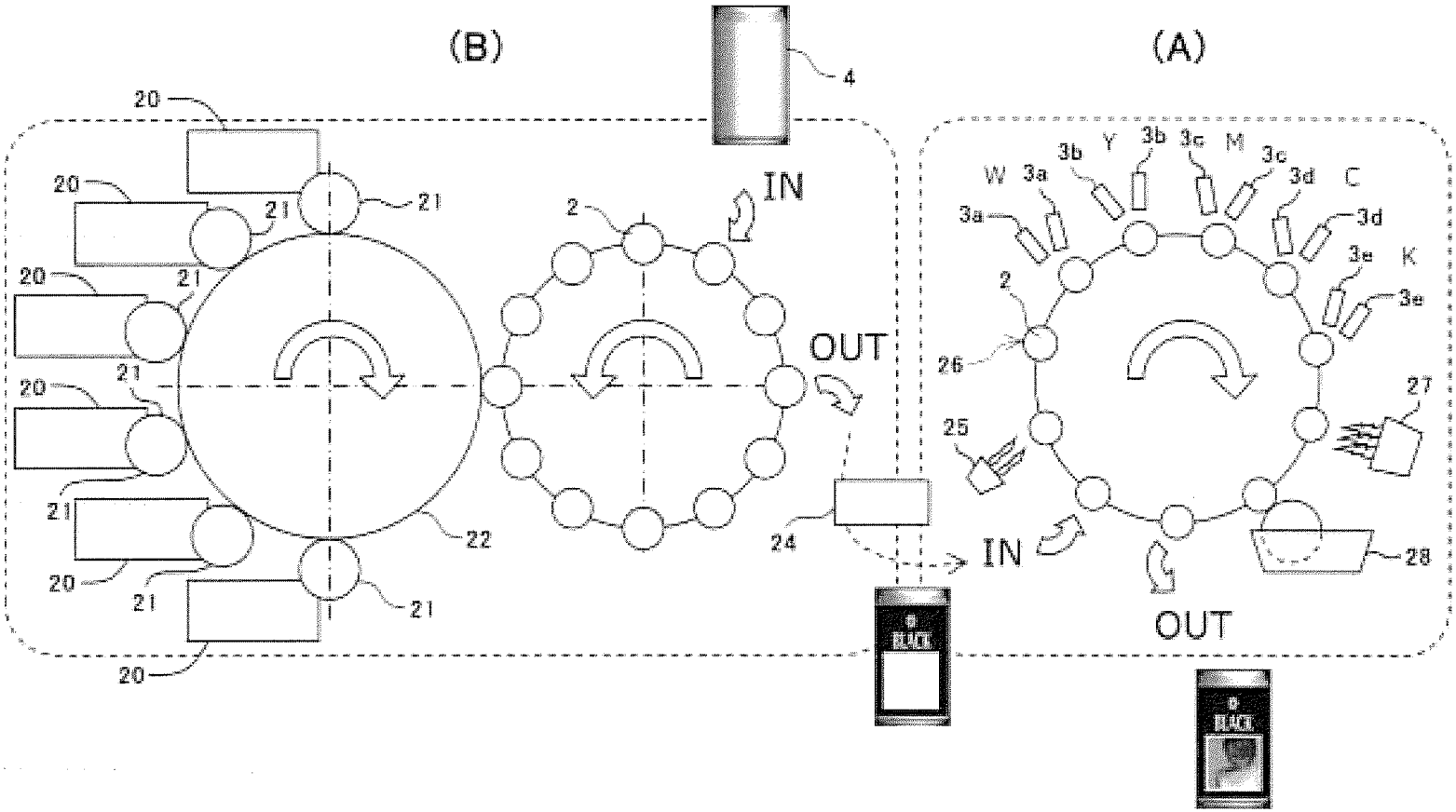
[FIG. 5] is a view illustrating a hybrid printing apparatus combining the ink-jet printing apparatus of the invention with a plate-type printing apparatus.

FIG. 5 is a view illustrating a printing method combining the ink-jet printing apparatus (A) of the invention with an independent plate-type printing apparatus (B). In the plate-type printing apparatus (B), the printing inks are fed from the ink-feed units 20, 20—to the printing plates (not shown) such as relief printing plates on the plate cylinders 21, and the inks on the dots and images of the printing plates are transferred onto a blanket 22. The inks of various colors transferred onto the blanket 22 are transferred onto the seamless cans fitted onto the mandrels 2 to obtain the seamless cans having images formed by the plate-type printing.

After the plate-type printing is executed by the plate-type printing apparatus (B) in FIG. 5, the seamless cans having image formed by the print-type printing are conveyed by a conveyer device 24 into the ink-jet printing apparatus (A) where the image formed by the plate-type printing is false-baked (designated at 25 in FIG. 5), positioned (designated at 26 in FIG. 5), and is subjected to the ink-jet printing, false-curing (false-baking) (designated at 27 in FIG. 5) and to the application of the finishing varnish (designated at 28 in FIG. 5).

Figure 6:
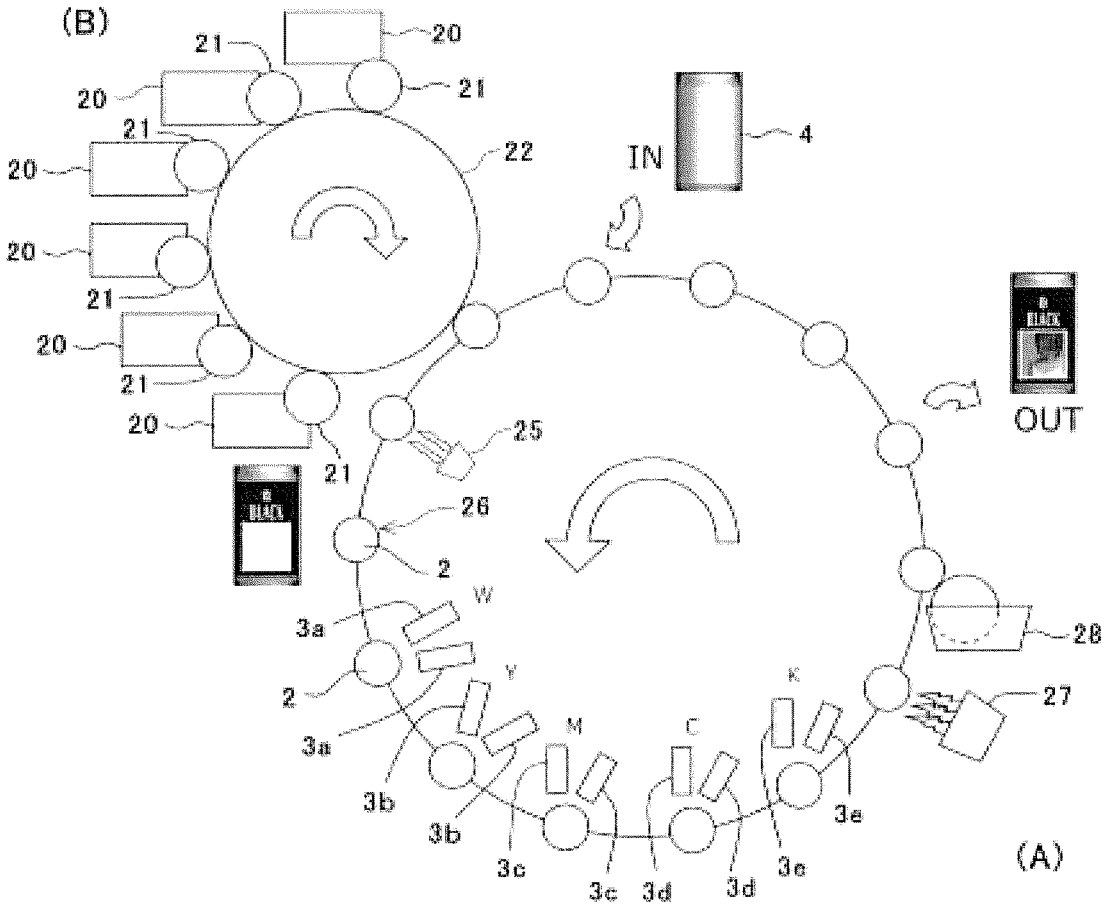
[FIG. 6] is a view illustrating a hybrid printing apparatus combining the ink-jet printing apparatus of the invention with the plate-type printing apparatus.

FIG. 6 is a view illustrating a printing method by using a hybrid apparatus which executes the ink-jet printing and the plate-type printing in the same apparatus. In FIG. 6, the seamless cans fitted onto the mandrels 2 are, first, subjected to the plate-type printing (B). Next, the image formed by the plate-type printing is false-baked (designated at 25 in FIG. 6), positioned (designated at 26 in FIG. 6) and is then subjected to the ink-jet printing, false-curing (false-baking) (designated at 27 in FIG. 6) and to the application of the finishing varnish (designated at 28 in FIG. 6).

In either embodiment, either the ink-jet printing or the plate-type printing may be executed first. From the standpoint of easy positioning and the art of design such as overlapped printing by ink-jet printing, however, it is specifically desired to execute the plate-type printing first.

In this case, further, it is desired to false-cure the image formed first on the seamless can to suppress the inks from spreading. This prevents the inks from blurring on the portions where the images are overlapped, and vivid images can be obtained.

Further, either when the plate-type printing and the ink-jet printing are executed by using separate printing apparatuses or by using the same printing apparatus, it is important to effect the positioning prior to conducting the next printing to obtain the printed images as desired. Therefore, an alignment mark for positioning is formed by the first printing. The is detected prior to conducting the next printing, the seamless can is positioned by controlling the turn of the mandrel mounting the seamless can, and the desired images are printed maintaining good reproducibility.

(Seamless cans)

As the seamless cans that are to be ink-jet printed according to the present invention, though not limited thereto only, there can be used those seamless cans that are made from various surface-treated steel plates such as tin-free steel sheets (TFS), steel sheets plated with tin or the like, light metal plates such as of aluminum, or resin-coated metal plates comprising the above metal plates coated with a thermoplastic resin such as polyester resin, that are formed through conventional means such as draw working, draw-ironing working, draw/redraw working, bend-stretch working (stretching) based on the draw/redrawing, bend-stretch/ironing based on the draw/redrawing, draw/ironing, or impact-working of a light metal plate.

The ink-jet printing apparatus of the invention can be favorably used not only for printing the seamless cans but also for printing the containers of cylindrical shapes; i.e., for printing such three-piece cans as welded cans and adhered cans.

It is, further, desired to form a white coating on the outer surface of the seamless cans since it conceals the ground color of the metal plate and enables the image to be vividly printed. It is, further, allowable to form a white solidly printed layer by executing the ink-jet printing in white color instead of forming the white coating.

It is further desired to form an anchor coating on the white coating or on the outer surface of the seamless can when no white coating is formed thereon. Upon forming the anchor coating, the image formed by the ink-jet printing is firmly fixed and adheres more closely. The anchor coating, further, reduces the blurring of the inks that are jetted.

The anchor coating can be formed by a known method; i.e., applying a coating solution obtained by dispersing or dissolving a heat-curable, ultraviolet ray-curable or electron ray-curable transparent polyester resin, acrylic resin, epoxy resin or urethane resin in a predetermined solvent, drying the thus formed coating, and curing the coating by heating, by the irradiation with ultraviolet rays or by the irradiation with electron rays. Of them, a method of heat-curing a heat-curable resin is preferred from the standpoint of a wide range of selection.

The white coating can be similarly formed by adding a white pigment such as titanium dioxide to a coating solution comprising a resin exemplified above for forming the anchor coating. A preferred method comprises heat-curing a coating solution obtained by dispersing or dissolving the heat-curable resin in a solvent.

Instead of forming the white coating, it is also allowable to form white pigment-containing layer on the outer surface of the seamless can by working a resin-coated metal plate obtained by coating a metal plate with a white resin coating that contains the white pigment in the resin coating of the thermoplastic resin-coated metal plate.

EXAMPLES

Concrete Examples of the ink-jet printing apparatus of the invention will now be evaluated below in comparison with the Comparative Examples of the conventional ink-jet printing apparatus.

Example 1

Figure 7:
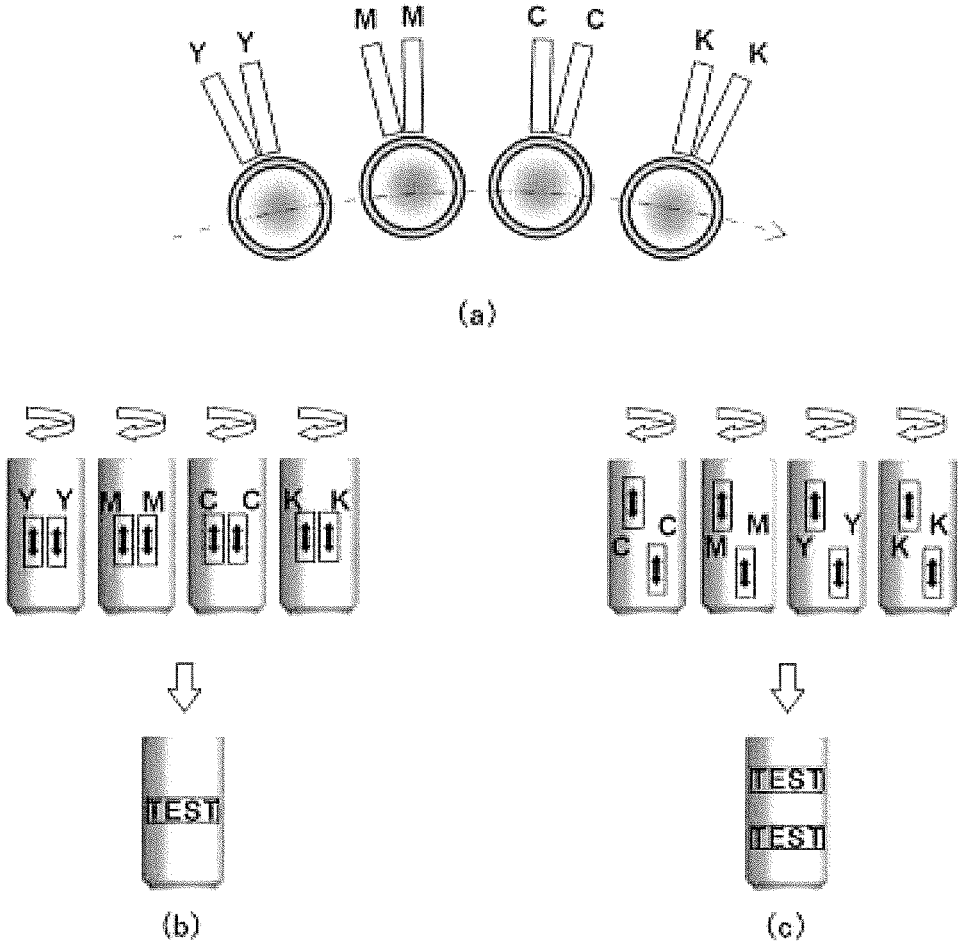
[FIG. 7] is a view illustrating an embodiment of the ink-jet printing apparatus of the present invention.

In the ink-jet printing apparatus of Example 1 as shown in FIG. 7(*a*), the ink-jet heads are arranged in a number of two in each of the printing stations. The printing stations are provided in a number of four, and the cleaning devices shown in FIG. 4 are provided in a number of four, i.e., one in each of the printing stations (so as to be shared by the two ink-jet heads).

The printing stations are disposed on the outer side of the revolving track (dotted line in FIG. 7(*a*)) of the mandrel wheel. The ink-jet heads are so arranged as will not overlap the revolving track of the mandrel wheel, and are facing downward neighboring each other over the revolving track. The two ink-jet heads in each printing station are of the same color. The ink-jet heads in their respective printing stations are arranged in order of Y-color, M-color, C-color and K-color in compliance with the revolution of the mandrel wheel.

In the ink-jet printing apparatus, the ink-jet heads are arranged in the circumferential direction of the seamless can to print an image at one place on the side wall of the seamless can as shown in FIG. 7(*b*), and are, further, arranged being deviated in the direction of height of the seamless can to print images at two places simultaneously on the side wall of the seamless can as shown in FIG. 7(*c*).

In the Example 1, the two ink-jet heads are arranged in parallel facing downward. Therefore, the two ink-jet heads can be cleaned by using one cleaning device. Further, since the two heads are arranged in each station, the resolution is doubled as compared to when only one ink-jet head is used provided the can rotates at the same speed.

Example 2

Figure 8:
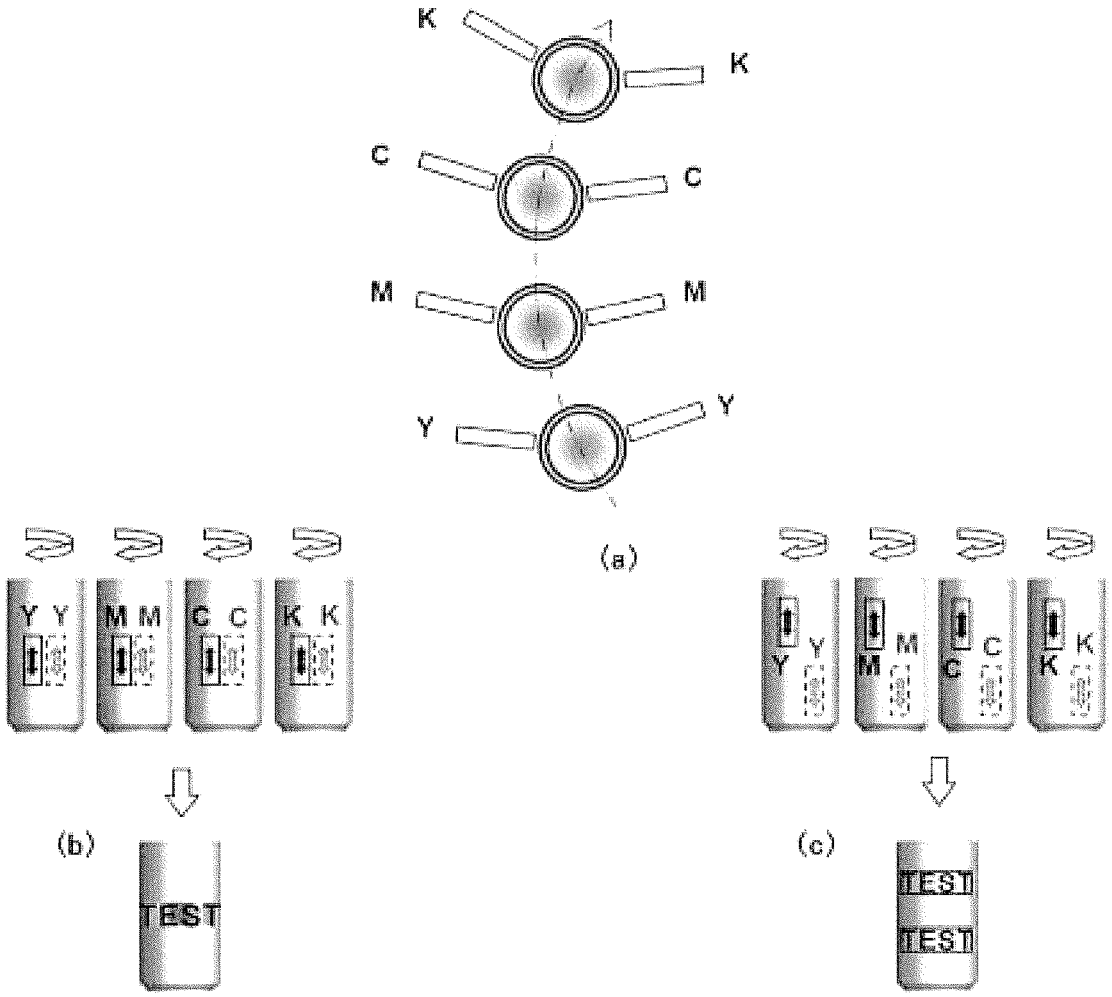
[FIG. 8] is a view illustrating an embodiment of the ink-jet printing apparatus of the present invention.

The ink-jet printing apparatus according to Example 2 has, as shown in FIG. 8, two heads in each printing station, i.e., one ink-jet head on the outer side of the revolving track (dotted line in FIG. 8(*a*)) of the mandrel wheel and another ink-jet head on the inner side of the revolving track with the mandrel sandwiched therebetween. Each printing station is disposed at a position to move in the up-and-down direction of the moving track of the mandrel wheel. The ink-jet heads are so disposed as will not overlap the revolving track of the mandrel wheel, the ink-jet heads facing downward as much as possible maintaining a minimum distance between the ink-jet heads and the can. There are four printing stations and eight cleaning devices (one for each ink-jet head). Each printing station has two ink-jet heads of the same color, the two ink-jet heads being disposed in order of Y-color, M-color, C-color and K-color as they go upward from the lower side in the drawing in compliance with the revolving track of the mandrel wheel.

In Example 2, too, the ink-jet heads are arranged in the circumferential direction of the seamless can to print an image at one place on the side wall of the seamless can as shown in FIG. 8(*b*), and are, further, arranged being deviated in the direction of height of the seamless can to print images at two places on the side wall of the seamless can as shown in FIG. 8(*c*).

Example 3

Figure 9:
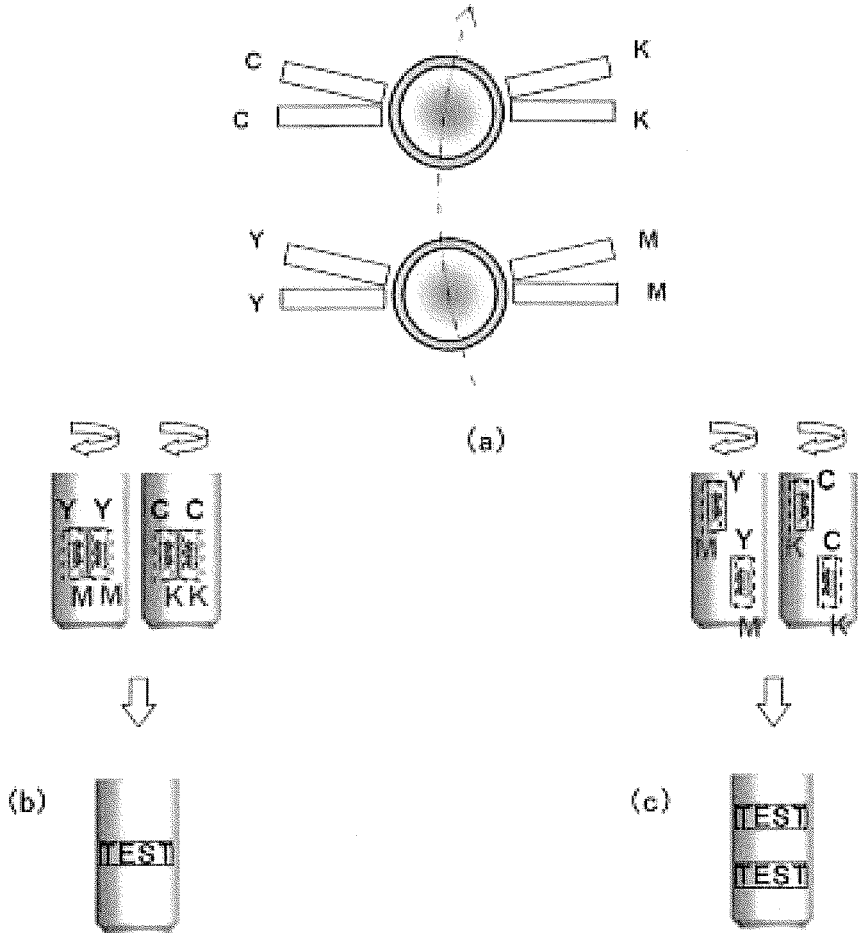
[FIG. 9] is a view illustrating an embodiment of the ink-jet printing apparatus of the present invention.

The ink-jet printing apparatus according to Example 3 has, as shown in FIG. 9, four ink-jet heads in each printing station, i.e., two ink-jet heads on the outer side of the mandrel wheel and two ink-jet heads on the inner side thereof with the mandrel (seamless can) sandwiched therebetween. Each printing station is disposed at a position to move in the up-and-down direction of the revolving track of the mandrel wheel. The ink-jet heads are so disposed as will not overlap the revolving track of the mandrel wheel, the ink-jet heads facing downward as much as possible maintaining a minimum distance between the ink-jet heads and the can. There are two printing stations and four cleaning devices (two ink-jet heads on each side sharing one cleaning device). Each printing station has, on each side, two ink-jet heads of the same color, the two ink-jet heads being so disposed as to execute the printing in Y-color, M-color, C-color and K-color accompanying the revolution of the mandrel wheel and the rotation of the can.

In Example 3, each printing station executes the printing in two colors requiring a decreased number of times of positioning the images, i.e., excelling from the standpoint of adjusting the deviation of images. The apparatus includes only two stations and can be realized in a small size.

In Example 3, too, the ink-jet heads are arranged in the circumferential direction of the seamless can to print an image at one place on the side wall of the seamless can as shown in FIG. 9(*b*), and are, further, arranged being deviated in the direction of height of the seamless can to print images at two places on the side wall of the seamless can as shown in FIG. 9(*c*).

Example 4

Figure 10:
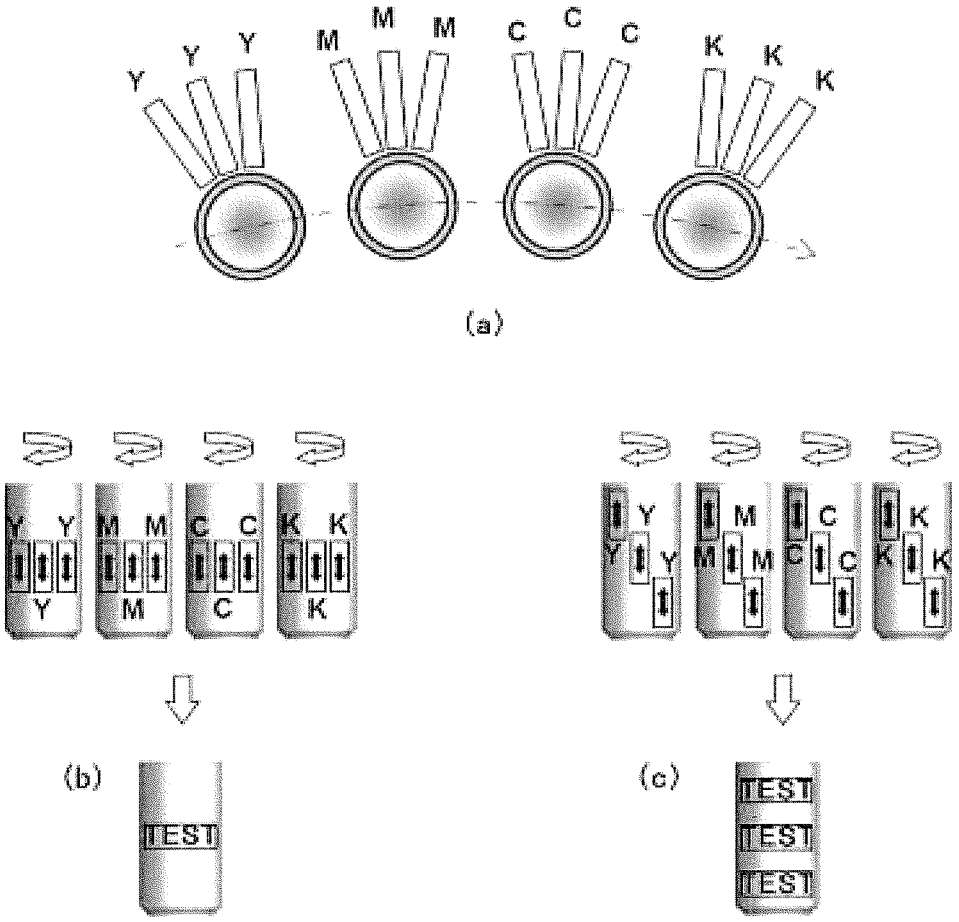
[FIG. 10] is a view illustrating an embodiment of the ink-jet printing apparatus of the present invention.

The ink-jet printing apparatus according to Example 4 has, as shown in FIG. 10, three ink-jet heads in each printing station, and has four printing stations and one cleaning device in each printing station (shared by three ink-jet heads). Each printing station is disposed at a position to move in the transverse direction of the revolving track of the mandrel wheel. The ink-jet heads are so disposed as will not overlap the revolving track of the mandrel wheel, the three ink-jet heads neighboring each other over the revolving track and facing downward. Each printing station has three heads of the same color, the three heads being disposed in order of Y-color, M-color, C-color and K-color in their respective printing stations in compliance with the revolution of the mandrel wheel.

In Example 4, each printing station has three ink-jet heads that inject ink of the same color. Therefore, the printing speed is high and the resolution excels in the direction of height of the can.

In Example 4, too, the ink-jet heads are arranged in the circumferential direction of the seamless can to print an image at one place on the side wall of the seamless can as shown in FIG. 10(*b*), and are, further, arranged being deviated in the direction of height of the seamless can to print images at a maximum of three places on the side wall of the seamless can as shown in FIG. 10*c*).

Comparative Example 1

Figure 11:
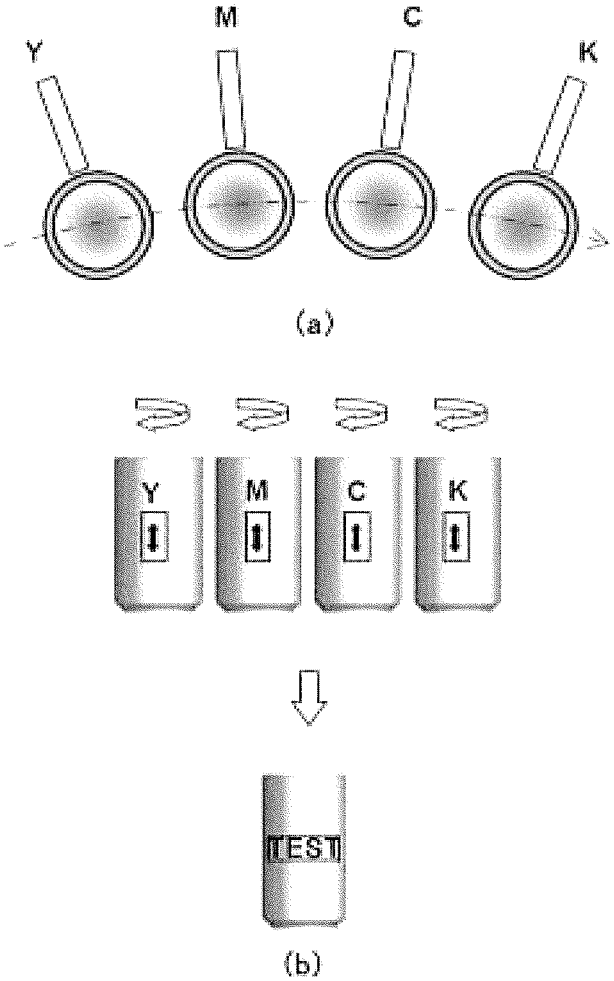
[FIG. 11] is a view illustrating an embodiment of a conventional ink-jet printing apparatus.

As shown in FIG. 11, described below in comparison with the ink-jet printing apparatuses of the present invention is a conventional ink-jet printing apparatus in which each printing station is provided with only one ink-jet head, the number of the printing stations being four and the number of the cleaning devices being four (one for each ink-jet head).

Each printing station is disposed at a position to move in the transverse direction of the revolving track of the mandrel wheel. The heads are disposed over the mandrels (seamless cans) facing downward. The heads are arranged in order of Y-color, M-color, C-color and K-color in compliance with the revolution of the mandrel wheel.

There is only one ink-jet head that has the same color and, therefore, the printing speed is slow. Unlike the ink-jet apparatus of the present invention, therefore, it is not allowed to form a plurality of images in the direction of height of the seamless can, and the resolution of the seamless can is poor.

Comparative Example 2

Figure 12:
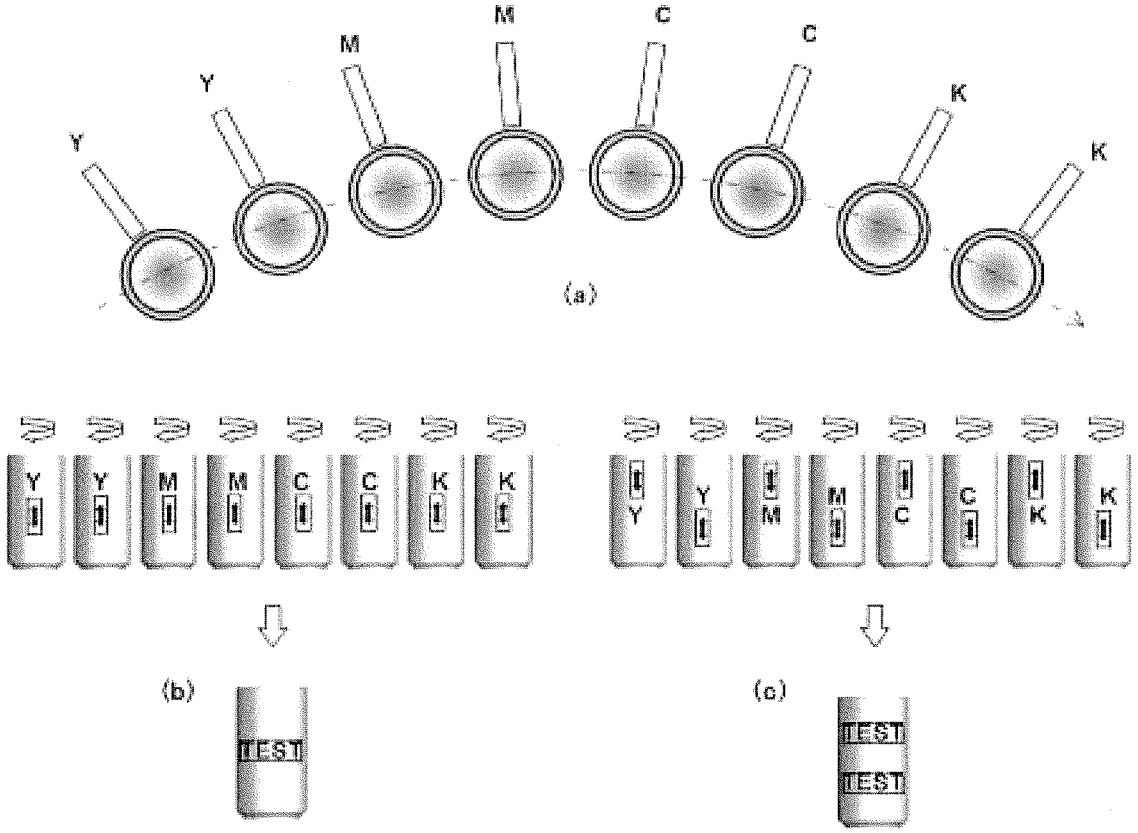
[FIG. 12] is a view illustrating an embodiment of a conventional ink-jet printing apparatus.

In Comparative Example 2, as shown in FIG. 12, each printing station has only one ink-jet head, the number of the stations being eight and the number of the cleaning devices being eight (one for each ink-jet head). Each printing station is disposed at a position to move in the transverse direction of the revolving track of the mandrel wheel. The ink-jet heads are disposed over the mandrels (seamless cans) facing downward. The heads are arranged in order of Y-color, M-color, C-color and K-color so as to execute the printing in two stations, respectively, in compliance with the revolution of the mandrel wheel.

In Comparative Example 2, there are so many printing stations that it is difficult to print the image in position accompanied by disadvantage in regard to deviation of images and size of the apparatus.

The above Examples 1 to 4 and Comparative Examples 1, 2 were measured and evaluated as described below to obtain the results as shown in Table 1 below.

Details of the printing specifications and the evaluated results are shown in Table 1. . Described below are the descriptions of items in Table 1.

<Printing specifications>

Figure 13:
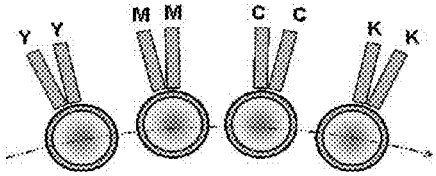
[FIG. 13] shows the arrangement of the station and the ink-jet heads for Example 1 to 4and Comparative Examples 1 and 2.
Figure 13:
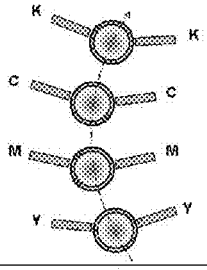
Figure 13:
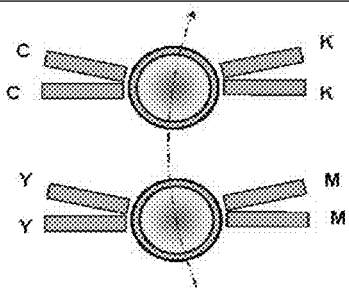
Figure 13:
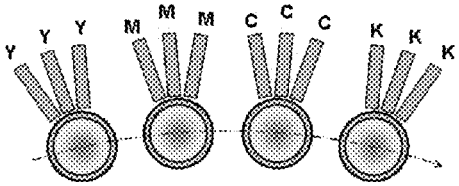
Figure 13:
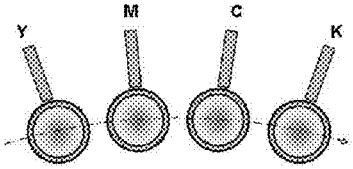
Figure 13:
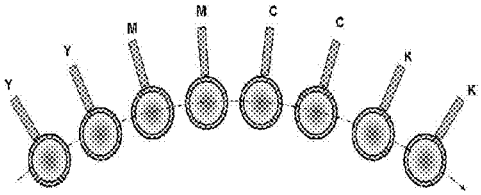

Table 1 shows the number of the heads in each station, number of the stations, and number of the cleaning devices. The length that could be printed by the ink-jet heads was 72 mm. FIG. 13 shows he arrangements of the stations and the ink jet heads.

<Evaluation>

Seamless cans of a can body diameter of 65 mm and a can height of 120 mm were produced by subjecting an aluminum alloy plate of a thickness of 0.30 mm to the draw-ironing and to the redraw-ironing followed by washing and drying. By using heat-curable inks of the solvent type, dot images were ink-jet-printed on the thus produced seamless cans, false-cured, coated with a finishing varnish, and were baked to obtain the printed seamless cans which were evaluated as described below.

<Printing speed>

The printing speed is a time required in each station for printing the images. The cans were rotated at a speed of 60 rotations per minute according to the traditional condition (Comparative Example 1). When the images were not formed as desired through one time of rotation, the speed of rotation was lowered. When the images could be printed at a higher rotating speed, the rotating speed was increased. Symbol ◎ represents a case of less than 0.5 sec, ○ represents a case of 0.5 sec, and × represents a case of longer than 0.5 sec.

<Image deviation>

By using an optical microscope, images ink-jet-printed on the seamless cans were observed on an enlarged scale in regard to distribution of the ink-jet-printed dots. Symbol ○ represents a case where the dots were equidistant and there was no image deviation, and × represents a case where the distance among the dots was greatly varying and the images were deviating.

<Resolution>

By using the optical microscope, dot density of the image ink-jet-printed on the seamless cans was observed on an enlarged scale to evaluate the resolution. When the ink-jet heads were neighboring to each other, the positions of the ink-jet heads were finely adjusted so that the gaps among the dots became dense. The rotating speed of the cans and the revolving speed of the mandrel wheel were maintained constant. Symbol ◎ represents a case where the dot density was excellently dense, ○ represents a case where the dot density was dense, and × represents a case where the dot density was sparse.

<Density appeal>

By using the optical microscope, dot density of the image ink-jet-printed on the seamless cans was observed on an enlarged scale to evaluate the density appeal. When the ink-jet heads of the same color were neighboring to each other, the positions of the ink-jet heads were finely adjusted so that the dots overlapped one upon the other. When the ink-jet heads of the same color were not neighboring to each other but were disposed in separate stations, the positions of the ink-jet heads were finely adjusted so that the dots overlapped one upon the other. The rotating speed of the cans and the revolving speed of the mandrel wheel were maintained constant. Symbol ○ represents a case where the dot density was dense and × represents a case where the dot density was lean.

<Size of the apparatus>

The sizes of the whole apparatuses inclusive of mandrels, mandrel wheel with stations, and head-cleaning devices, were evaluated on the basis of the specifications of Comparative Example 1 (four stations, four cleaning devices). Comparative Example 1 was presumed to be ○. Namely, symbol ○ represents a case where the size was equal to that of Comparative Example 1 or was compact, and × represents a case where the size was larger.

<Printing at positions of different heights>

Possibility was evaluated for printing images at positions higher than the head length in the direction of height of the can body. Symbol ◎ represents a case when three or more kinds of images could be printed at different heights of the can, ○ represents a case where two kinds of images could be printed, and × represents a case where no image could be printed at a different height on the can.

<Continuation of printing>

In cleaning the ink-jet heads, ○ represents a case when the printing could be continued by using other ink-jet heads and X represents a case when the printing could not be continued.

<Overall evaluation>

Overall evaluation was rendered based on the evaluations of "printing speed", "image deviation", "resolution", "density appeal", "size of the apparatus", "printing at positions of different heights" and "continuation of printing".

TABLE 1

| | Specifications | | | Evaluation | | | | | | | |
|---|---|---|---|---|---|---|---|---|---|---|---|
| | *1 | *2 | *3 | *4 | *5 | *6 | *7 | *8 | *9 | *10 | *11 |
| Ex. 1 | 2 | 4 | 4 | 0.5 sec (○) | ○ | ○ | ○ | ○ | ○ | ○ | ○ |
| Ex. 2 | 2 | 4 | 8 | 0.5 sec (○) | ○ | ○ | ○ | ○ | ○ | ○ | ○ |
| Ex. 3 | 4 | 2 | 4 | 0.5 sec (○) | ○ | ○ | ○ | ○ | ○ | ○ | ○ |
| Ex. 4 | 3 | 4 | 4 | 0.3 sec (◎) | ○ | ◎ | ○ | ○ | ◎ | ○ | ○ |
| Comp. Ex. 1 | 1 | 4 | 4 | 1.0 sec (×) | ○ | × | × | ○ | × | × | × |

TABLE 1-continued

| | Specifications | | | Evaluation | | | | | | | |
|---|---|---|---|---|---|---|---|---|---|---|---|
| | *1 | *2 | *3 | *4 | *5 | *6 | *7 | *8 | *9 | *10 | *11 |
| Comp. Ex. 2 | 1 | 8 | 8 | 0.5 sec (○) | × | × | × | × | ○ | ○ | × |

*1: Number of heads in each station
*2: Number of stations
*3: Number of cleaning devices
*4: Printing speed
*5: Image deviation
*6: Resolution
*7: Density appeal
*8 Size of apparatus
*9: Printing at different heights
*10: Continuation of printing
*11: Overall evaluation

INDUSTRIAL APPLICABILITY

Due to errors in the mechanical precision and in the sizes of the mandrels, it was, so far, difficult to attain fine positioning between the printing stations, and images were deviated and dispersion occurred in the printing. The ink-jet printing apparatus of the present invention now makes it possible to reproduce images appealing a high degree of density at a high printing speed, without causing images to be deviated and maintaining high resolution, and can, therefore, be preferably applied to producing seamless cans on which fine images such as photographs are printed.

Upon arranging a plurality of ink-jet heads that can move in the direction of height of the seamless cans, it is allowed to execute the printing at a plurality of positions in the direction of height of the seamless cans and onto the seamless cans of different heights, offering variable nature (variability) enabling the designs to be printed to be freely changed in short periods of time. Therefore, the ink-jet printing can be favorably applied to producing printed seamless cans on which a variety of designs are to be printed in small lots.

By using the plate-type printing in combination, further, it becomes possible to combine variable images by the ink-jet printing and the solidly printed images by the plate-type printing having excellent reproducibility of density. Namely, the invention can be favorably applied to the production of printed seamless cans having vivid images formed by the plate-type printing and on which the images are, further, formed by the ink-jet printing.

Moreover, the number of the printing stations can be decreased, the printing apparatus can be realized in a small size, the apparatus does not become bulky even when it is combined with the plate-type printing apparatus, and the apparatus can be favorably utilized as the ink-jet printing apparatus combining the plate-type printing apparatus.

Since the ink-jet heads can be alternately cleaned, the printing can be continued without interruption.

The invention claimed is:

1. A printing apparatus for printing images on seamless cans comprising: a mandrel wheel, a plurality of rotary mandrels that are provided on the mandrel wheel, and ink-jet printing stations for ink-jet printing images on at least the can walls on the outer surfaces of seamless cans fitted onto the mandrels, wherein the seamless cans are printed seamless cans on which the images and a positioning mark have been printed by a plate-type printing, a positioning station provided upstream of the ink-jet printing stations so as to detect the positioning mark printed by the plate-type printing, control rotation of the mandrels mounting the printed seamless cans, and thereby position the printed seamless cans;

wherein the ink-jet printing is executed in at least four ink-jet printing stations, wherein the at least four ink-jet printing stations individually correspond to Y-color, M-color, C-color and K-color, wherein individual ones of the at least four ink-jet printing stations comprise a plurality of ink-jet heads, and individual ones of the plurality of ink-jet heads contain the corresponding color of the ink-jet printing station, wherein the plurality of ink-jet heads are arranged in a circumferential direction of the seamless cans and are deviated in a direction of the height of the seamless cans such that two images can be printed simultaneously on a side-wall of the seamless cans, and wherein the ejection ports of the plurality of ink-jet heads are directed downward or directed downward and tilted.

2. The printing apparatus for printing images on seamless cans according to claim 1, wherein the plurality of the ink-jet heads arranged in the ink-jet printing station are movable in the direction of height of the seamless cans fitted onto the mandrels.

3. The printing apparatus for printing images on seamless cans according to claim 1, wherein the plurality of ink-jet heads arranged in the ink-jet printing station are provided at positions facing each other with the seamless can fitted onto the mandrel therebetween.

4. The printing apparatus for printing images on seamless cans according to claim 1, wherein a false-curing station and a finishing varnish application station are successively provided at positions on the downstream of the ink-jet printing station.

5. The printing apparatus for printing images on seamless cans according to claim 1, wherein a plate-type printing station is provided at a position either upstream or downstream of the ink-jet printing station to print images on at least the can walls on the outer surfaces of the seamless cans by plate-type printing.

6. The printing apparatus for printing images on seamless cans according to claim 1, wherein a head-cleaning device coupled to the ink-jet heads is arranged in the ink-jet printing station.

7. The printing apparatus for printing images on seamless cans according to claim 6, wherein the head-cleaning device is shared by at least two ink-jet heads.

8. A method of printing images by ink-jet printing on at least can walls on the outer surfaces of seamless cans, wherein the ink-jet printing is executed by using a plurality of ink-jet heads in at least one time of printing step, the seamless cans are printed seamless cans on which the images and a positioning mark have been printed by a plate-type printing, a positioning step prior to ink-jet printing is executed to position the printed seamless cans by detecting the positioning marks printed by the plate-type printing and controlling the rotation of the mandrels mounting the printed seamless cans, the ink-jet printing is executed in at least each of four ink-jet printing stations which individually correspond to Y-color, M-color, C-color and K-color printing, and wherein individual ones of the at least four ink-jet printing stations comprise a plurality of ink-jet heads that are arranged in a circumferential direction of the seamless cans and are deviated in a direction of the height of the seamless cans such that two images can be printed simultaneously on a side-wall of the seamless cans, wherein individual ones of the plurality of ink-jet heads contain the color corresponding to the ink-jet printing station, and the ejection ports of the plurality of ink-jet heads are directed downward or directed downward and tilted.

9. The printing method according to claim 8, wherein the images are formed on at least the can walls on the outer surfaces of the seamless cans by moving the ink-jet heads in the direction of height.

10. The printing method according to claim 8, wherein the seamless cans on which the ink-jet printing is to be executed are the seamless cans on which the images have been printed by the plate-type printing.

* * * * *